US008914962B1

(12) United States Patent
Rozzi-Ochs et al.

(10) Patent No.: US 8,914,962 B1
(45) Date of Patent: Dec. 23, 2014

(54) BUOY SPLIT KEY REMOVAL DEVICE

(71) Applicant: U.S. Department of Homeland Security, Washington, DC (US)

(72) Inventors: Jessica Rozzi-Ochs, Old Mystic, CT (US); Bret Jacobson, New London, CT (US); Khiem Nagy, Tariffville, CT (US); Erin Nolan, Lafayette, IN (US); Evan Rice, Seattle, WA (US); Sarah Troch, Oakland, CA (US)

(73) Assignee: The United States of America, as Represented by the Secretary, Department of Homeland Security, Washington, DC (US)

( * ) Notice: Subject to any disclaimer, the term of this patent is extended or adjusted under 35 U.S.C. 154(b) by 0 days.

(21) Appl. No.: 14/246,182

(22) Filed: Apr. 7, 2014

(51) Int. Cl.

| | |
|---|---|
| ***B23P 19/00*** | (2006.01) |
| ***B63B 22/08*** | (2006.01) |
| ***B63B 22/04*** | (2006.01) |

(52) U.S. Cl.
CPC ..... *B63B 22/04* (2013.01)
USPC ..... 29/426.6; 441/7

(58) Field of Classification Search
USPC ..... 29/426.6, 426.1, 426.5, 426.4; 441/1, 7, 441/133
See application file for complete search history.

(56) References Cited

U.S. PATENT DOCUMENTS 6,539,894 B1 * 4/2003 Byrne et al. ..... 119/234

* cited by examiner

*Primary Examiner* — John C Hong
(74) *Attorney, Agent, or Firm* — Lavanya Ratnam; William Washington

(57) ABSTRACT

A buoy split key ("BSD") removal apparatus, system, and method are disclosed. The BSD utilizes a power screw to apply a steady and controllable compressive load onto the split key. The BSD applies a compressive force or load to the bitter ends of the split key in order to maximize the use of the moment on the split key. The spread and/or twisted split key is compressed by a compression assembly and compression power screw as supported by a compression frame. The compression assembly provides steady and controllable compression on a buoy split key. A compression power screw and extrusion power screw should be threaded in the opposite direction for maximum torque to remove the buoy split key. Once the split key is fully compressed by the compression assembly, the compressive load from the power screw and split key are then removed.

20 Claims, 9 Drawing Sheets

BUOY SPLIT KEY REMOVAL DEVICE

STATEMENT REGARDING FEDERALLY SPONSORED RESEARCH OR DEVELOPMENT

The United States of America may have certain rights to this invention under the Secretary of the Department of Homeland Security and the Commandant of the United States Coast Guard. All embodiments herein were invented by cadets and their advisors at the United States Coast Guard Academy.

TECHNICAL FIELD

The disclosed embodiments relate to buoy split keys. The disclosed embodiments further relate to devices for safely and efficiently removing buoy split keys. The disclosed embodiments also relate to compressing buoy split keys when bent and twisted.

BACKGROUND OF THE INVENTION

Buoy tender crews face severe safety issues when removing split keys from a buoy shackle. A buoy is weighed down to the floor of the body of water by a chain attached to a concrete block. The chain connects the buoy by a shackle, held shut by a pin and split key, as shown in the exemplary pictorial illustration 100 of FIG. 1. The split key is butterflied, thus preventing the pin from slipping out of the shackle. A buoy cannot be worked until it is separated from the chain. Separation occurs after entirely removing the split key from the shackle. When in the water, the split key often becomes mangled, resulting in a difficult and dangerous removal process. Prior proposed solutions are problematic as grave safety issues arise during buoy split key removal using brute force and a hammer alone. Numerous people are often injured using the current method which consisted of using a pair of 8 lbs hammers.

When removing the split key from the shackle, three possible scenarios may occur. In the first scenario, the split key is in good condition, i.e., the split key is in its original installation condition. Because split keys are typically butterflied to approximately 90 degrees, a crew member utilizes two sledge hammers to apply the necessary force to bring the split key back into its original position to be removed. In the second scenario, the split key is foul, bent, and/or twisted to odd angles of distortion which make it difficult to remove using the hammer method described in the first scenario. When the split key is bent between 90 to 140 degrees with a slight twist, removal of the split key problematically requires working with a chisel or a wedge prior to removal with a sledge hammer. Finally in the third scenario, the split key is completely mangled being bent past 140 degrees and has a large amount of twist in it. There is no easy or safe way to get the split key off with any kind of hand held tools. The only way to remove the split key is to use a blow torch with high heat intensity to cut the split key off. The second and third scenarios describe time consuming, inefficient, and unworkable proposed solutions to removing a bent split key.

Current tools used to remove split keys include a split key punch, a blacksmith's punch hammer, and a blacksmith's chisel hammer. The split key punch are typically machined from a Blacksmith's Chisel, a hammer that is flat on one side but beveled on the other. This punch is machined to produce a rectangle on the beveled side that is 2⅛" high, ⅜" thick and 1⅜" wide. This punch is used to knock 1st, 2nd, and 3rd class split keys out of the shackle pins. The blacksmith's punch hammer is square on one end and has a round flat tip on the other. It is used to drive the pin out of a shackle after the key has been removed. This is also called a pin drift hammer. The blacksmith's chisel hammer, also known as a split key hammer, is flat on one end and beveled on the other. This hammer is used to spread the key, a large flat cotter pin, which holds a shackle pin in the shackle. It provides the best means of putting the required 45 degree separation in the split key. It is easiest to turn the shackle on deck, placing the blacksmith chisel into the key opening and hitting it with a blacksmith's hammer.

Therefore, a need exists for a buoy split key removal device ("BSD") that removes buoy split keys in an efficient and workable manner when the prongs are deformed from its original condition or spread.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide for improved efficiently and safety in removing buoy split keys.

It is another aspect of the disclosed embodiments to provide for compressing buoy split keys when bent and twisted.

It is a further aspect of the disclosed embodiments to provide for quick and efficient buoy split key removal.

The above and other aspects can be achieved as is now described. A buoy split key ("BSD") removal apparatus, system, and method are disclosed. The BSD utilizes a power screw to apply a steady and controllable compressive load onto the split key. The BSD applies a compressive force or load to the bitter ends of the split key in order to maximize the use of the moment on the split key. The spread and/or twisted split key is compressed by a compression assembly and compression power screw as supported by a compression frame. The compression assembly provides steady and controllable compression on a buoy split key. A compression power screw and extrusion power screw should be threaded in the opposite direction for maximum torque to remove the buoy split key. Once the split key is fully compressed by the compression assembly, the compressive load from the power screw and split key are then removed.

In an embodiment, a buoy split key removal apparatus is disclosed. The apparatus comprises: a compression assembly comprising a compression cart and a compression power screw, wherein the compression cart grips a pin back rest of a buoy split key, and the compression power screw compresses the pin back rest of the buoy split key and the compression power screw is thereafter released; and an extrusion assembly comprising an extrusion cart and an extrusion power screw, wherein the compressed buoy split key is lined up with the extrusion cart and wherein the extrusion power screw moves in an opposite manner of the compression power screw, thus releasing the buoy split key. In another embodiment, the apparatus further comprises a power screw collar, wherein the power screw collar is placed on top of a shackle pin of the buoy split key to connect the compression assembly to the buoy split key. In other embodiments, the compression power screw and the extrusion power screw are threaded in opposite directions. In yet another embodiment, the compressive power screw applies a steady and controllable compressive load onto the buoy split key. In one embodiment, the apparatus further comprises at least one compression arm connected to a power screw collar and gears to maintain steady and controllable compression, wherein a gear end of the at least one compression arms is housed in a casing with a circular collar attached to a gear box. In another embodiment, the power screw collar is placed on top of a buoy split key shackle pin, wherein a clamp slides over an end of a compressed the buoy split key when the buoy split key is fully compressed. In other embodiments, the extrusion assembly further comprises a horizontal power screw extrusion collar, wherein the horizontal power screw extrusion collar ensures the extrusion assembly is in parallel alignment with the extrusion power screw.

In yet another embodiment, a buoy split key removal system is disclosed. The system comprises: a buoy split key, wherein prongs of the buoy split key are spread or damaged; a compression assembly comprising a compression cart and a compression power screw, wherein the compression cart grips a pin back rest of a buoy split key, and the power screw compresses the pin back rest of the buoy split key and the compression power screw is thereafter released; and an extrusion assembly comprising an extrusion cart and an extrusion power screw, wherein the compressed buoy split key is lined up with the extrusion cart and wherein the extrusion power screw moves in an opposite manner of the compression power screw, thus releasing the buoy split key. In an embodiment, the buoy split key comprises a 1st-3rd class buoy split key. In other embodiments, the system further comprises a power screw collar, wherein the power screw collar is placed on top of a shackle pin to connect the compression assembly to the buoy split key. In another embodiment, the compression power screw and the extrusion power screw are threaded in opposite directions, and wherein the compression power screw and the extrusion power screw are turned via a drill in a drill fitting on the compression power screw and the extrusion power screw. In another embodiment, the compressive power screw applies a steady and controllable compressive load onto the buoy split key. In one embodiment, the system further comprises at least one compression arm connected to a power screw collar and gears to maintain steady and controllable compression, wherein a gear end of the at least one compression arms is housed in a casing with a circular collar attached to a gear box. In another embodiment, the power screw collar is placed on top of a buoy split key shackle pin, wherein a clamp slides over an end of a compressed the buoy split key when the buoy split key is fully compressed. In yet another embodiment, the extrusion assembly further comprises a horizontal power screw extrusion collar, wherein the horizontal power screw extrusion collar ensures the extrusion assembly is in parallel alignment with the extrusion power screw.

In an embodiment, a buoy split key removal method is disclosed. The method comprises: compressing a damaged or bent buoy split key via a compression assembly comprising a compression cart and a compression power screw, wherein the compression cart grips a pin back rest of a buoy split key, wherein the compressive power screw applies a steady and controllable compressive load onto the buoy split key and the power screw compresses the pin back rest of the buoy split key and the compression power screw is thereafter released; and releasing the damaged or bent buoy split key via an extrusion assembly comprising an extrusion cart and an extrusion power screw, wherein the compresses buoy split key is lined up with the extrusion cart and wherein the extrusion power screw moves in an opposite manner of the compression power screw. In another embodiment, the method further comprises utilizing a power screw collar, wherein the power screw collar is placed on top of a shackle pin thus connecting the compression assembly to the buoy split key. In other embodiments, the compression power screw and the extrusion power screw are threaded in opposite directions. In yet another embodiment, the method further comprises connecting at least one compression arm to a power screw collar and gears to maintain steady and controllable compression, wherein a gear end of the at least one compression arms is housed in a casing with a circular collar attached to a gear box, wherein the power screw collar is placed on top of a buoy split key shackle pin, wherein a clamp slides over an end of a compressed the buoy split key when the buoy split key is fully compressed. In an embodiment, the extrusion assembly further comprises a horizontal power screw extrusion collar, wherein the horizontal power screw extrusion collar ensures the extrusion assembly is in parallel alignment with the extrusion power screw.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

The embodiments now will be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
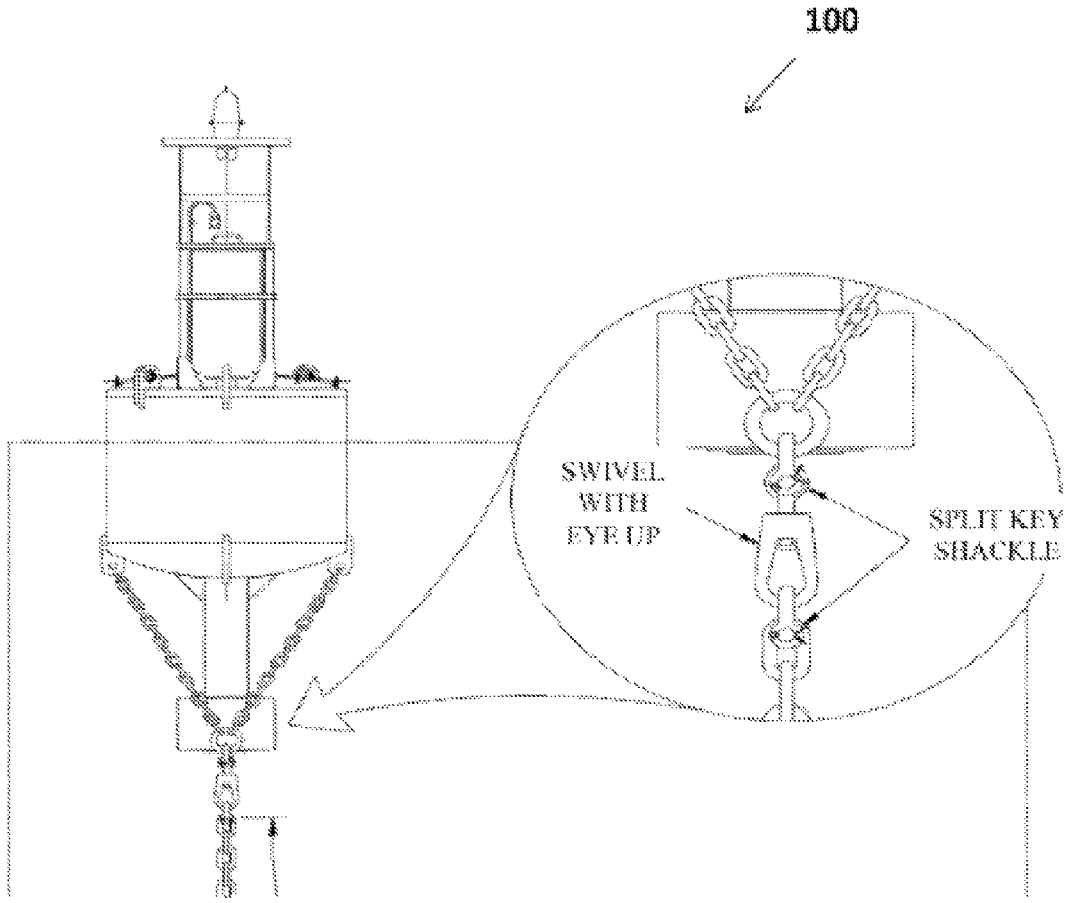
Prior Art FIG. 1
FIG. 1 illustrates an exemplary pictorial illustration of a buoy chain configuration, according to an embodiment.
Figure 2:
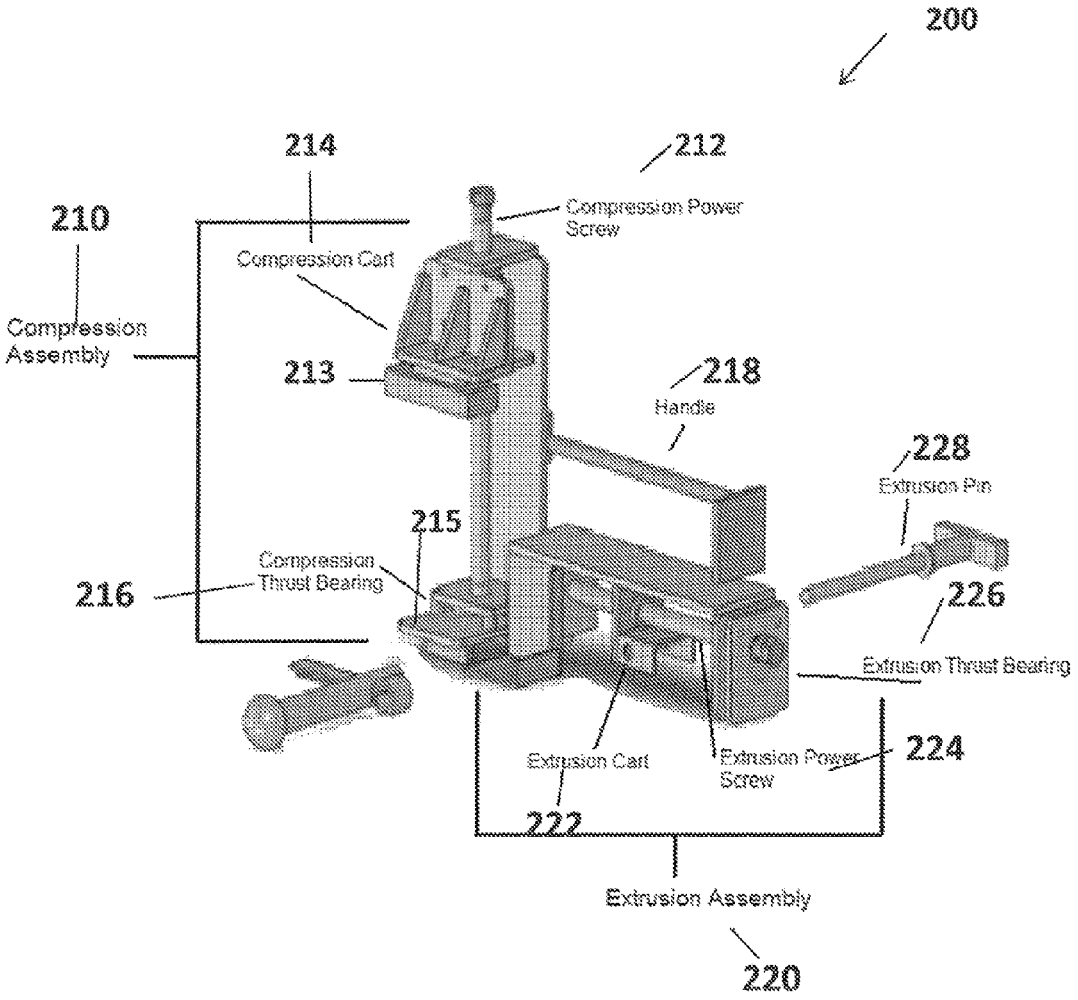
FIG. 2 illustrates an exemplary pictorial illustration of a buoy split key removal device, according to a preferred embodiment.

FIG. 2 illustrates an exemplary pictorial illustration 200 of a buoy split key removal device ("BSD"), in accordance with a preferred embodiment. The disclosed BSD provides for the compression and removal of the split key. The device applies a compressive force or load to the bitter ends of the split key in order to maximize the use of the moment on the split key. The disclosed BSD applies gradual and controllable compressive load onto the split key. The design utilizes the mechanical advantage of a power screw to apply a gradual and controllable load to compress the stainless steel split key. The device has the capability to be hooked up to an optional external power source for easy and fast compression of the split key. When used, the BSD removes a split key in 45 seconds. The device is operable by one person with one hand on the device and their other hand on the drill. The BSD enables easy removal of the split key once successfully compressed, reducing removal time from an estimated 3200 hours per year to 2049 hours per year.

The BSD comprises a compression assembly 210, extrusion assembly 220, and handle 218. These three assemblies 210, 218, 220 are welded together to produce the BDS. The extrusion assembly 220 is welded to the to the compression assembly 210. The handle 218 is then welded to the welded compression assembly 210 and extrusion assembly 220. The compression assembly 210 comprises a compression power screw 212, compression cart 214, and compression thrust bearing 216. The extrusion assembly 220 comprises an extrusion cart 222, extrusion power screw 224, extrusion thrust bearing 226, and extrusion pin 228. The compression and extrusion power screws 212, 224 both require a ¾" stainless steel hex nut fitting. The supply source for operating the compression and extrusion assemblies 210, 220 can be either a standalone 24-volt power drill or a compressed air power drill. The handle 218 comprises of a piece of pipe welded to two pieces of steel stock that is coated with a rubber grip.

The preferable power screws for the buoy split key removal device are a 0.625" screw with a pitch of 8. The change in power screw would increase the speed of the operation and decrease the amount of torque that is required for the device. The power screw used should also have machined fittings on the end that match the fitting that are available on the buoy deck. The compression power screw 212 and extrusion power screw 224 should be threaded in the opposite direction. When the compression power screw 212 is right handed and the extrusion power screw 224 is left handed, the torque wrench direction does not need to be changed between the two. The torque wrench can be directly moved from backing off the compression plates to extruding the split key without having to switch the direction of the power screw.

Figure 3:
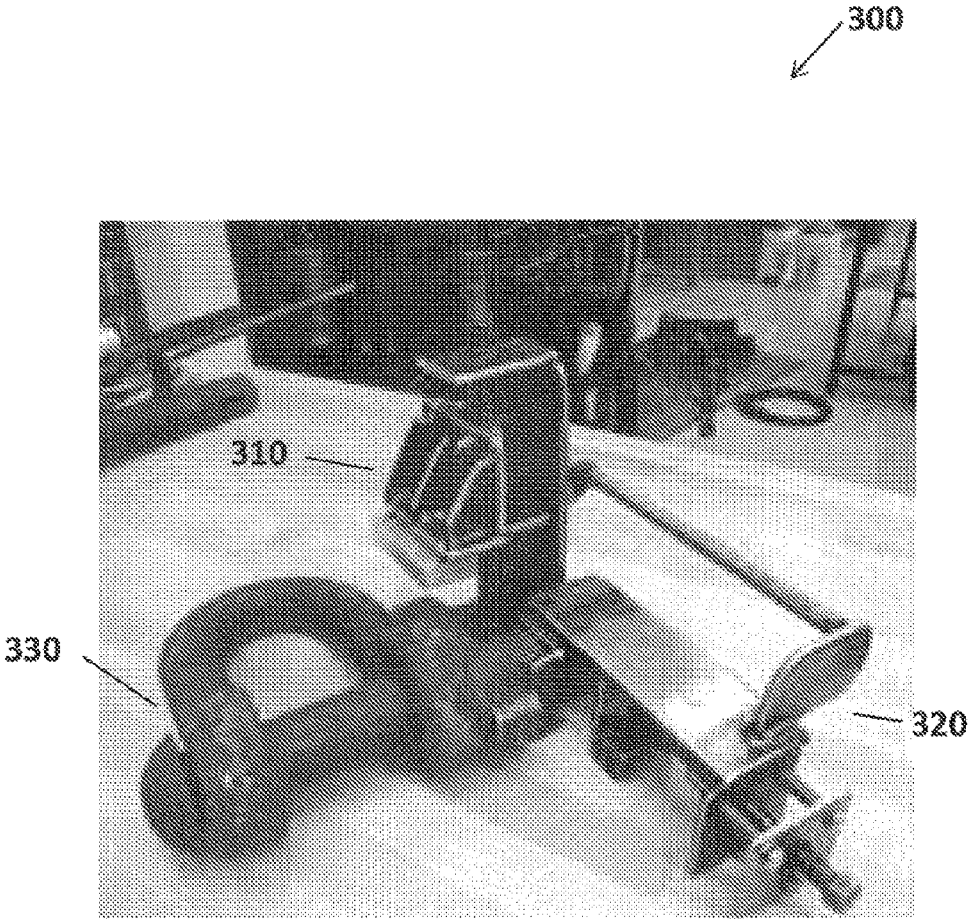
FIG. 3 illustrates an exemplary pictorial illustration of a buoy split key removal device and associated split key, according to an embodiment.

FIG. 3 illustrates an exemplary pictorial illustration 300 of a buoy split key removal device and associated split key 330, according to an embodiment. To prepare the BSD for use, move both the compression and extrusion carts 214, 222 to the starting position. The compression assembly 210 is opened and the extrusion cart 222 is lined up with the pin back rest. When compressing the split key 330, place the drill fitting on top of the compression power screw 212, the drill should be set up to run in the clockwise direction for compression. Run the drill until the bolt is compressed make sure that the shackle pin does not move during this process. After the spilt key is compressed, switch the direction of the drill and release the compression until the split key is free of the compressive top and base plates 213, 215. To remove the split key, line up the eye of the split key with the bolt holes of the extrusion cart 222, insert the extrusion bolt, and place the cordless drill on the extrusion bolt. Then ensure that the bottom of the pin is in the correct position, and drive the drill clockwise until a sharp ping is heard, this will indicate that the split key is free.

To remove the device from the shackle and chains, ensure that the split key is clearly visible (free of barnacles as much as possible) and butterfly to no more than 140 degrees. Holding the handle 218 of the BSD, snuggly fit the device so the shackle pin is resting against the back stopper on the extrusion assembly 220. Ensure that the split key is resting on the compression base plate 215 and that neither split key arms are resting perpendicular to the compression top plate 213.

Experiments

Initial testing was conducted to determine the forces that will be necessary to remove the split key from the shackle. The tests were conducted for 1st-3'd class split keys and 4th class split keys. There were several critical forces required for the design that needed to be measured using the results of the experimentation. These forces were required to calculate the stresses within the various components and were essential to the design of these components.

Compression Test: This test used the Tinius-Olsen machine to record the force required to compress the split key using the Tinius-Olsen machine. The split keys were opened to 140 degrees and then loaded until they completely closed. The compression force was recorded immediately after the arms of the split key closed.

Extrusion Test: This test used the Tinius-Olsen machine and a custom built apparatus to pull the split key out of the pin. These forces were required to size the required components of the bottle opener preliminary design option. The test was conducted using a frame that pulled the on the pin and the eye of the split key and pulled the split key out through the hole in the pin.

Cutting Test I: This test used a constructed frame examining whether or not cutting the split key is a practical approach for removal. The apparatus consisted of a guillotine frame constructed of A36 steel and three cutting blades at angles of 30°, 45°, and 60° degrees constructed of A36 steel. The blades and the frame were all heated to 900° C. for 10 minutes quenched then annealed at 400° C. for 4 minutes. The test utilized the hydraulic press in the lab to apply the necessary load to attempt to shear the split key.

The test resulted in the destruction of the testing device and failed to shear the split key with the blades. In addition, the blades suffered sufficient damage. As a result of this test it was concluded that the experiment should be run again with a stronger testing apparatus and harder blades.

Cutting Test II: This test repeated the setup of cutting test I but used 440 stainless as the material for the blades and the shearing edge of the guillotine. The cutting frame was built with tighter tolerances that prevented the frame from twisting. This cutting test resulted in two successful shears of the fourth class split key, each requiring about 200 psi of force from the hydraulic press; however, each blade used to perform this test was destroyed in the process. The blade suffered sufficient damage to make a subsequent test with the $1^{st}$-$3^{rd}$ class split key impossible. Each time a blade was used to attempt to cut the split key the split key would wrap around the blade and become caught in the guillotine frame. It took approximately 20-30 minutes to separate the components afterwards which eliminated any time advantage cutting would provide. This test led to the elimination of cutting as a possibility.

From the cost analysis and initial testing, the inventors embodiments focus on the idea of applying a compressive force or load to the bitter ends of the split key in order to maximize the use of the moment on the split key. Testing proved that compression was the most viable option. This was further supported with the collection of data from talking to first hand operators and observers who witness and operated the current method of bending the split key. Current operators demonstrated that such a force is efficient and highly effective at bending the split key back into its original shape. The BSD group decided to pursue a design that would apply gradual and controllable compressive load onto the split key. Compressive loading could slow down the process because of the high yield strength of stainless steel.

The design utilized the mechanical advantage of a power screw to apply a gradual and controllable load to compress the 316 stainless steel split key. The design was incorporated both the triangle frame and the clamp design into one design. The design also has a device that will also enable for the easy removal of the split key once it had been successfully compressed.

Compression Arms: The compression arm is made out of low carbon, 1018, U-channel steel. The piece has a base of 2" and legs of 1". The material is uniformly 3/16" in thickness. This material is a commercially available U-channel steel. The material is significantly lighter than a solid bar of steel while retaining much of its strength. The U-channel leaves space for the power screw to move throughout its range of motion without interference.

Force Analysis: The force of the split key used was 800 lbs. for both bending and torsion stress. For the bending stress, the maximum moment present on the arm, 1166.67 ft.-lbs. was used. The value of 'y' used was half of the width of the beam, 0.5 in. The 'I' value used was a tabulated value for U-channel beams and was calculated to be 0.05989 $in^4$. The maximum bending stress was calculated to be 9.74 ksi. For torsion stress, the torque value was calculated by multiplying the force of the split key by its distance from the center of the beam. This value was found to be 2400 in-lbs. The value of 'r' was found to be at the outer corner of the U-channel steel at 1.118 in. The value of 'J' was found from a tabulated formula for U-channel was calculated to be 0.007965 $in^4$. The calculated value for the maximum torsion stress present in the beam is 337 ksi.

From these values it is apparent that stress due to torsion will be the most dominant factor in the stresses placed on the compression arms. It will be very important to use a material that has a yield strength higher than the maximum stresses found in these calculations. If that cannot be achieved, the compression arm design may be revised to reduce the torsion stresses.

In compression plate bending analysis, the chosen geometry for the contact plate of the device is a square block measuring 1.5"×1.5"×0.25" as shown below. The value used for V is 400 lbs. This is one half of the experimentally determined force needed to dose the split key, then multiplied by a safety factor of 2. The force is divided in half because each contact plate will only be applying % of the force that is closing the split key. The value of y was calculated by dividing the thickness of the plate by 2. The value for 'I' was found using the equation $(1/12)bh^3$. The cross sectional area used for the 'I' calculation is the horizontal area measuring 1/5" by 0.25", with b=1.25" and h=0.25". Using $\sigma=MY/I$ the maximum amount of bending force felt by the contact plate in this geometry and loading is 76800 psi or 76.8 ksi.

In the compression plate shear analysis, the shackle split key is made out of stainless steel that ranges from 1/8" to 3/16" thick per side of the key. In order to bend the split key, a certain amount of force must be applied to both sides of the split key. This force was determined experimentally to be around 500 lbs. for the largest split key. In order to close the split key, the contact pin on our device must be able to withstand this amount of shear force. The method used to calculate shear force is $\tau=VQ/It$. When performing this calculation several assumptions are being made. It is assumed that shear force is the only force being felt by the pin, there is no bending. The calculations assume that the force applied to the pin will be evenly distributed at all times. The calculations were performed with a safety factor of 2.

The chosen geometry for the contact pin of the device is a square block measuring 1.5"×1.5"×0.25" as shown below. The value used for V is 500 lbs. This is one half of the experimentally determined force needed to close the split key, then multiplied by a safety factor of 2. The force is divided in half because each contact pin will only be applying ½ of the force that is closing the split key. The value of Q was calculated by multiplying the cross sectional area by ½ the depth. The value for 1 was found using the equation $(1/12)bh^3$. The cross sectional area used in both Q and I calculation is the horizontal area measuring 1/5" by 0.25". T is the thickness of the plate, 0.25". Using is $\tau=VQ/It$, the maximum amount of shear force felt by the contact pin in this geometry and loading is 8000 psi.

The required face width for the gears is based on the selected diameter of 1 inch, 12 teeth, and a constant rotational speed of 2 rpm. The forces exerted on the arm by the power screw and the split key was also factored into the calculation. The minimum face width was found to be 0.207 in with a safety factor of 0.207 in. A face with of up to 1 in can be accommodated by the available space. A design face width of 0.25 in was selected resulting in a safety factor of 1.2.

Power screws are a device used in machinery to change angular motion into linear motion as well as transmit power. Common applications of power screws are lead screws of lathes, and screws for vices, presses and jacks. Power screws are classified by their thread type. There are three types of threads used, square, ACME and buttress. Power screws are typically operated for short durations. The advantages to power screws are that they can hold large loads and have a high mechanical advantage ratio. They are compact and simple to design. They generate precise linear motion. ACME threads have a 29° thread angle. They are not as efficient as the square thread because of the increase friction caused by the thread angle.

The torque required from the power screw is dependent on the diameter of the power screw. The force needed to close the split key was assumed to be 1600 lbs. This number was taken from the results of the Compression Test. The friction factor was assumed to be 0.17. This number assumed that the screw material will be oiled steel. The calculation was done using the standard diameters and threads per inch for Unified Fine series screws.

The calculation resulted in a range of screw diameter that would be possible for the torque wrench to drive. The following equation was used.

$$T_R = \frac{Fd_m}{2}\left(\frac{l + \pi f d_m}{\pi d_m - fl}\right)$$

F=load $d_m$=mean diameter of the screw f=friction factor l=1/Pitch

Figure 7:
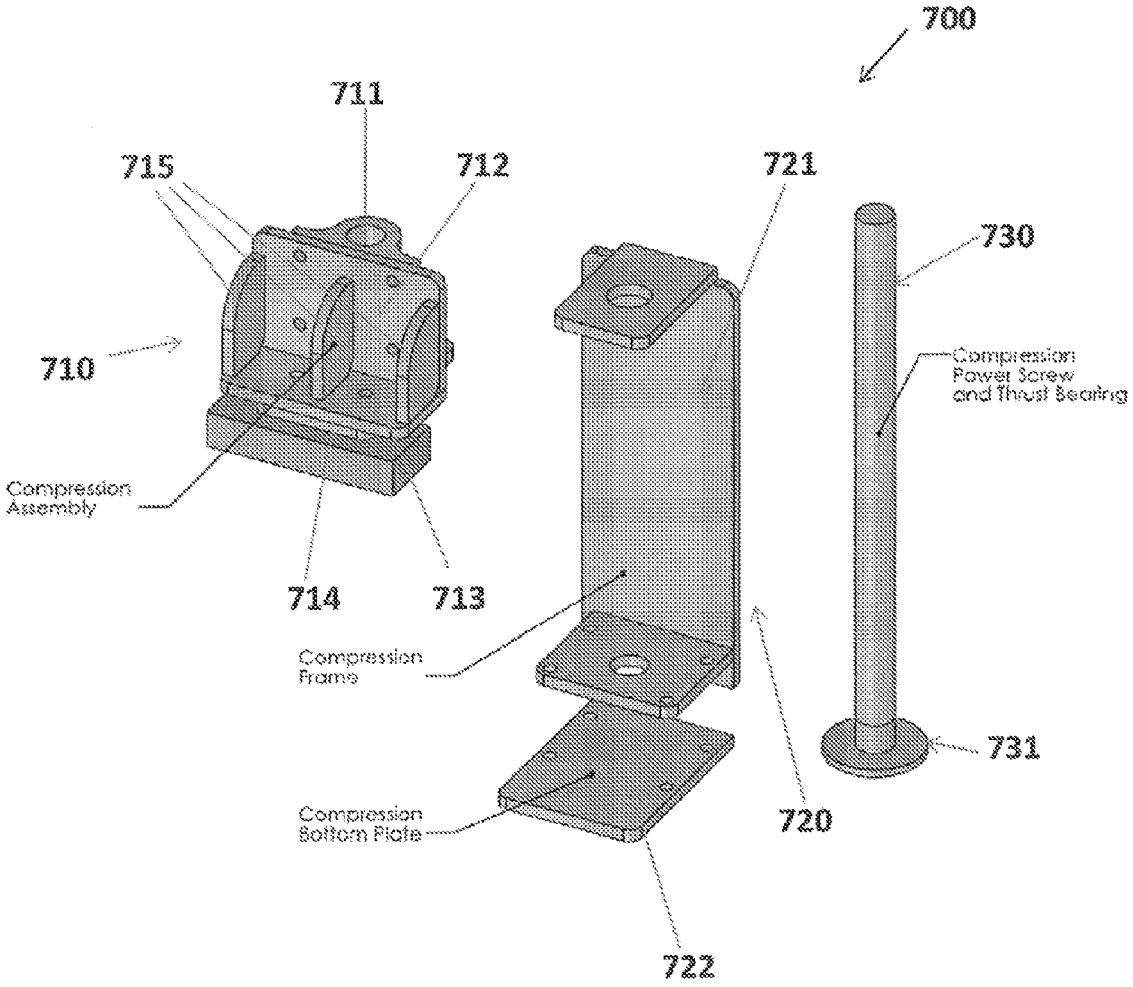
FIG. 7 illustrates an exemplary pictorial illustration of compression assembly components of the buoy split key removal device, according to an embodiment.

The buoy split key removal device as designed requires a torque of 6.76 ft.-lbs. to close a $1^{st}$ and $3^{rd}$ class split key. Cordless drills turn the power screw on the BSD. A range of commercially available cordless drills from 18V to 24V all satisfied this requirement. The power screw collar (as illustrated in FIG. 7 as numeral 720) bolted connection was designed using a ¼ grade 5 unthreaded bolt. The thinnest the sides of the compression arms were determined to be 0.07 inches of 1040 steel. The design factors for this calculation are as follows. This was the thinnest the members could be made before the any of the design factors fell beneath one. The BSD's tail clamp was sized based on the results of the tail clamp sizing test. The design was based around certain desired dimensions and the necessary thickness was calculated to ensure that the tail clamp would bend at the critical points. The calculations were completed with a safety factor of two.

Corrosion: To prevent uniform attack corrosion, a regular cleaning and maintenance schedule will be developed and a protective coating may be applied. A cleaning and maintenance schedule will help to prevent this type of corrosion by limiting the device's exposure to the saltwater environment. It will also help to detect any corrosion damage before it becomes too advanced. A protective coating may also be applied to aid in preventing this type of corrosion. A coating would physically separate the material from the surrounding environment. This would prevent corrosion as long as the coating stays intact.

To prevent galvanic corrosion, metals will be chosen that are similar when possible. When it is not possible to use similar materials, all joints will be electrically isolate with rubber gaskets or some other material. Using metals that are similar will prevent galvanic corrosion by eliminating the difference that causes the galvanic cell to form. When this is not possible, isolated the different components will prevent galvanic corrosion by disrupting the current between the metals. Without the current passing between the metals, the galvanic cell does not function and the materials will stay intact.

To prevent pitting corrosion, the steps used to prevent uniform attack corrosion will be used. Regular maintenance will help to prevent a stagnant environment from developing. Without the stagnant environment, pitting will not occur. A protective coating will prevent pitting by physically separating the material from the stagnant environment. This will prevent pitting as long as the coating stays intact.

Figure 4:
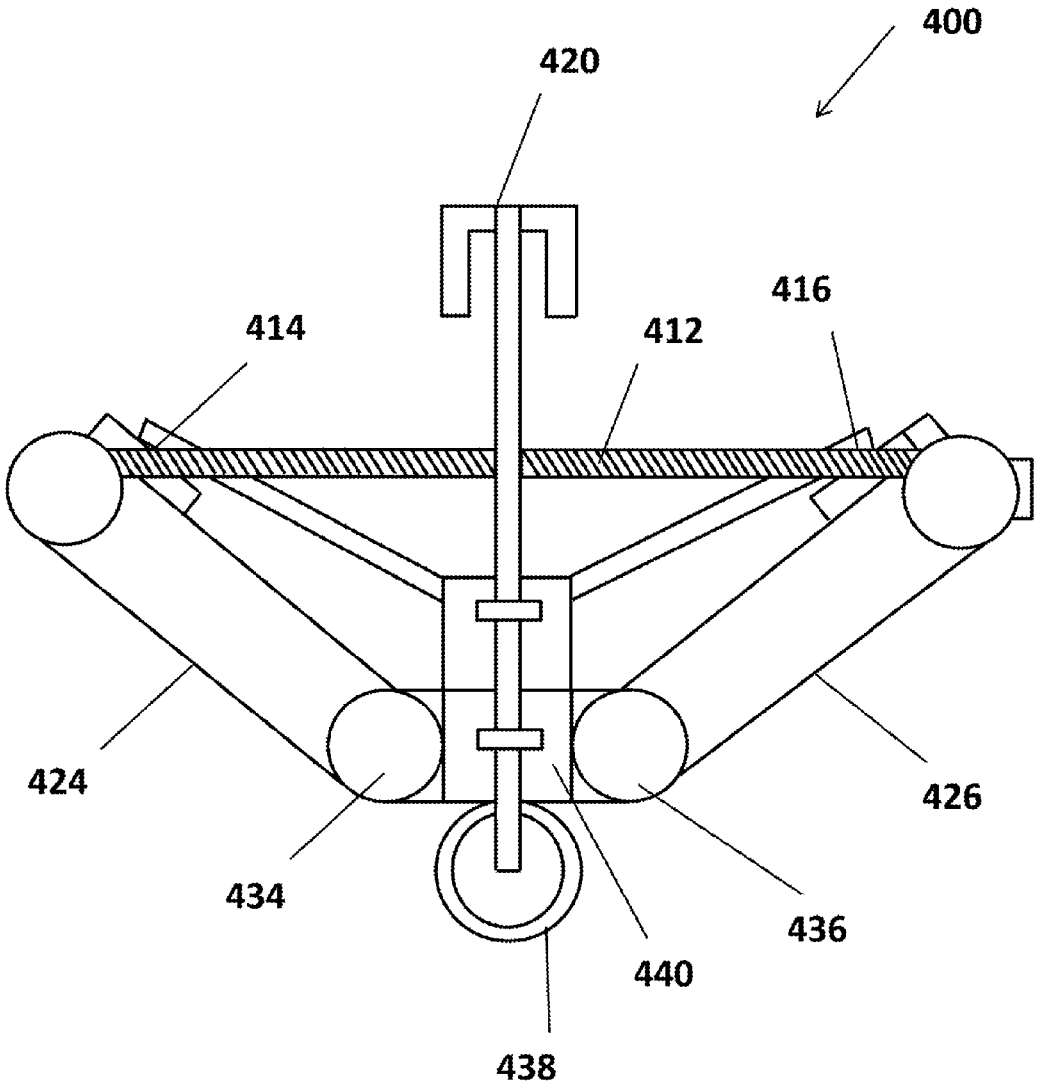
FIG. 4 illustrates an exemplary pictorial illustration of a first alternate embodiment of the BSD.

FIG. 4 illustrates an exemplary pictorial illustration 400 of a first alternate embodiment of the BSD. The pictorial illustration 400 of the first alternate embodiment of the BSD uses a power screw 412 to apply a steady and controllable compressive load onto the split key. The split key will be compressed by a set of plates 414, 416 that are welded to the respective compression arms 424, 426. The compression arms 424, 426 will be connected to the power screw collar 420 by a bolt on one end and the other end will be welded to a set of gears 434, 436. The gears 434, 436 will maintain the steady and controllable compression. The design will be capable of compressing a split key that had been spread up to a 140 degrees with a twist. The gears 434, 436 at the end of the compression arms 424, 426 will be housed in a casing. The casing will have a circular collar 438 welded to the bottom of the gear box 440. The collar 438 will be placed right on top of the shackle pin and will serve as a primary connection between the device and the split key. This collar 438 will be modified to fit the $1^{st}$, $2^{nd}$, $3^{rd}$, and $4^{th}$ class pins. Once the split key is fully compressed, a clamp will slide over the end of the compressed split key, the compressive load from the power screw 412 will then be removed and the split key will be removed by means of a hook or by hand.

The advantage of the current design is that it has a device for the removal of the split key as well as compressing the split key. The drawback to this device is that it does not have the capability to cut the split key. The device is also small and will weigh less than 20 lbs. There is no external power cords connected to the device, and the device has the capability to be hooked up to an external power source. The external power source will allow for the easy and fast compression of the split key.

Second Alternate Embodiment

Figure 5:
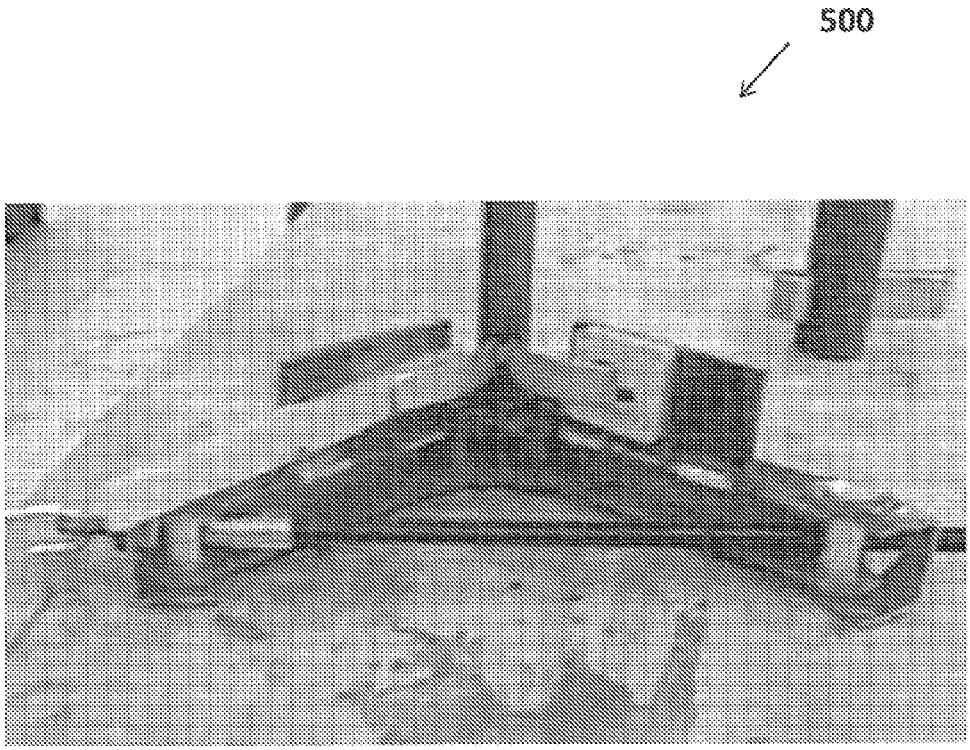
FIG. 5 illustrates an exemplary pictorial illustration of a second alternate embodiment of the BSD.

FIG. 5 illustrates a pictorial illustration 500 of a second alternate embodiment of the disclosed BSD. A prototype of the device was crafted from using half of a car jack and A36 steel plates. This prototype was tested for closing of a $4^{th}$ class split key and a $1^{st}$ class split key that were spread to a 140°. The prototype was also tested with manual closing as well as using an external power source such as a cordless power drill. The prototype successfully closes the split key in less than 45 sec.

Second Alternate Embodiment Laboratory Testing

The Buoy Split Key Removal Device second alternate embodiment was placed on top of a table. The buoy split key was placed into the pin and butterflied out to 140° from the centerline. The shackle pin was then set into the angle steel on the base of the prototype. Spacer plates were inserted in between the split key and the compression plates to ensure that the split key would be fully compressed when the prototype was in the closed position.

The $4^{th}$ class split key took about 20 seconds to close using a drill operating at a slow speed. The speed was limited by how the drill was attached to the power screw. Once there is a better fitting, the drill's speed can be increased to decrease the time it takes to close the split key. The $4^{th}$ class split key closed smoothly without any bending or damage to the prototype. The 1st-3rd class split dosed in about 45 seconds using a drill operating at a slow speed. The drill speed was limited by how the drill was attached to the power screw. The attachment started to spin in the drill rather than spinning the car jack so it had to be stopped and tightened again. The compression arms of the prototype began to twist slightly as the split key was being compressed. The compression plates also bent out slightly.

The second alternate embodiment worked on both types of split keys, however there was some bending when the $1^{st}$-$3^{rd}$ class split key was compressed. For the final design, the compression arms should be made of a higher carbon steel alloy such as 1040 steel. The piece should be thicker than what is used in the prototype. The sides of the U channel being used should also be shorter to minimize the bending from the compression plates. The compression plates on the prototype are made out of A-36 steel and the final design will be made out of a higher carbon steel that will better resist bending during compression. Both split keys can also be compressed manually if the need arises.

In the initial embodiments, the device was too big, especially the power screw. It would not fit between the buoy and the deck of the cutter. The tail clamp was too small to be used effectively, especially in cold weather. It was also not effective at all. Initial concern focused on the use of electric drills on the buoy deck because of the wet environment. The entire device was too precise to be used on the buoy deck quickly and easily. It would be very difficult to move the chain into the device. The chain is very heavy and would require several people to move into position. The ship would also need to bring in more chain than they normally would. The device must be operable by one person. Gloves are worn at all times on the buoy deck, so the device must be large enough to be operated with gloves on. There also is a lot of growth on the buoys when they are brought up. The device must be able to accommodate accordingly. Several safety notes that were made were that a person cannot touch the live chain or step over live chain. When working with the chain, chain hooks must be used at all times.

Third Alternate Embodiment

Figure 6:
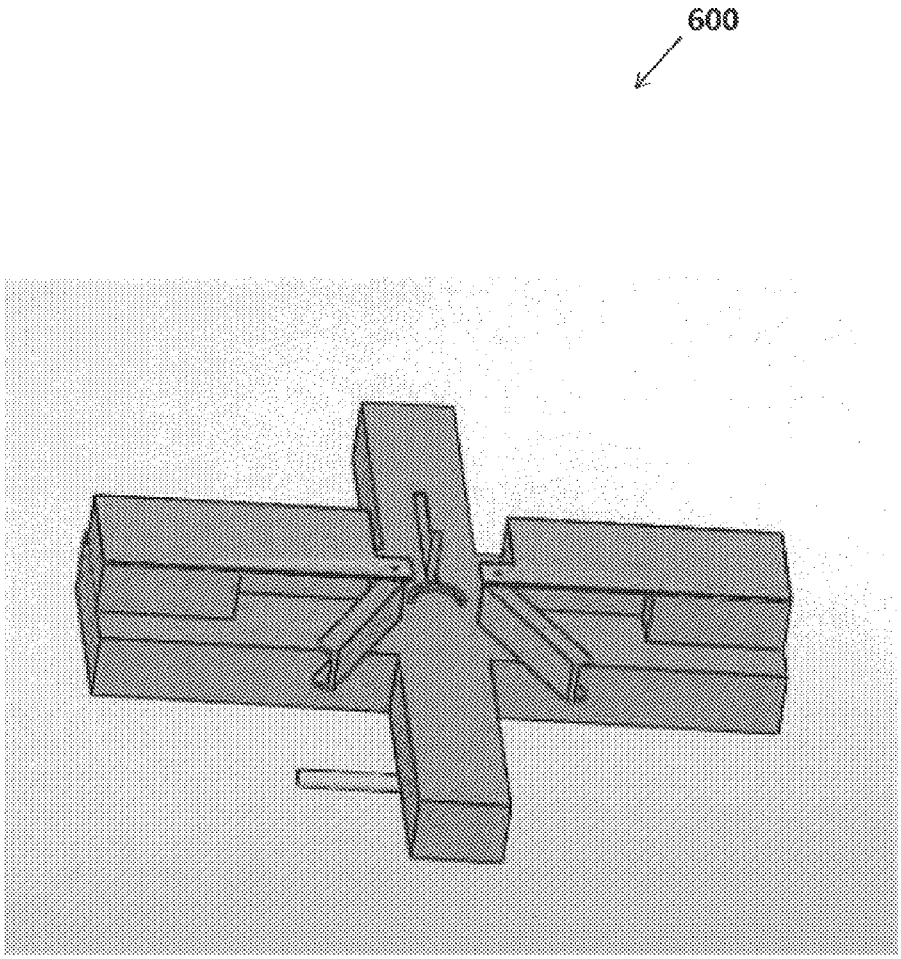
FIG. 6 illustrates an exemplary pictorial illustration of a third alternate embodiment of the BSD.

FIG. 6 illustrates a pictorial illustration 600 of a third alternate embodiment of the disclosed BSD. The tail clamp of the Buoy Split Key Removal Device second alternate embodiment was redesigned and the device mounted on a block similar to what is used in the heat and beat process. This would provide for a more stable platform to work with. The BSD second alternate embodiment was mounted to make it more user friendly and fleet applicable. This design change will change several of the design parameters previously established. The device will no longer weigh less than twenty pounds. The device will still be operable by a single person. The redesigned configuration will contain a more complicated mechanism but will require fewer steps to complete the process to extract the split key from the shackle.

Mounting the device allowed redesign of the tail clamp to make that process faster and easier for the user. The block would provide a place to rest the chain while it is being worked on and would make it easier to get the shackle into the needed position to remove the split key. This design will also keep all of the power inputs for the device on one side of the chain. The configuration improves user safety by keeping the operator's hands from reaching across the chain.

Tail Clamp Redesign. The second alternate embodiment utilized a tail clamp to keep the split key closed while removing it from the pin. The third alternate embodiment design will replaced the tail clamp with a rack and gear mechanism that will pull out the split key from the pin. The rack and gear method required fewer steps to perform and will keep the operators hands further away from the chain and shackle during the evolution. The rack and gear will be housed in the mounting block and a pin will stick up from the rack and will be inserted into the eye of the split key. Once the split key has been compressed the pressure will be released. The user will switch the power drill from the compression arms insert to the rack and gear insert. Although the mechanism will be more complicated in this method the user inputs will be minimized. This method will also reduce the amount of time required to fully remove the split key from the pin.

Advantages of Third Alternate Embodiment. The major advantage of re-orienting the compression arms and discarding the contact plates is that the torque is removed from the compression arms. In the current configuration, the resistance from the split key is offset from the compression force provided by the power screw. These offset forces create a very strong torque that limited the amount of compressive force that the device was able to provide. In the second alternate embodiment, this torque twisted the compression arms until they were plastically deformed and was not able to close a first class split key. By removing the contact plate and mounting the arms such that the split key directly contacts the arm, the torque is removed. In the new configuration, the resistive force of the split key and the compressive force of the power screw both act along the central axis of the arm. This will greatly improve the device's compressive capabilities as it will not be limited by twisting of the arms.

This design change requires a few other small design changes such as lowering the spot where the shackle pin sits and moving the compression arm pivot points. Lowering the spot where the shackle pin will rest consists of removing the solid gear casing and placing the pin supports directly on the mounting box. This allows the split key to remain in line with the center of the compression arms. This also requires the connection pins of the compression arms to be spaced further apart. This will create a larger space for the prongs on the split key to enter through. These changes are all minor modifications that will greatly improve the performance of the device by eliminating the torque in the compression arms.

Disadvantages of Third Alternate Embodiment. The construction of third alternate embodiment comprised a box that had the following dimension, 3"×30"×30". However, after calculating the amount of steel required for the construction of the box, the calculated weight of the box far exceeded the new maximum 60 lbs weight limitation. The first step taken to reduce the total gross weight of the device was to trim down the device. The new device now looks like a plus sign, where the corners were cut away from the original square box. Even with removing excess materials from the device, the weight remains to be a 90 lbs tool. Although the new device is to be stationary, the 90 lbs gross weight exceeded the target weight of 60 lbs. Another weight reduction strategy that was examined was to reduce the thickness of the steel plates use for the device construction. The original thickness was chosen to be ¼" thick steel, but the new thickness chosen was ⅛" thick steel. A quick stress analysis of the supporting sides was calculated and the safety factor far exceeded the desire safety factor of 2. The device will also consist of several supporting internal columns in order to increase the device strength and stiffness.

Returning to the preferred embodiment, the extrusion pin 228 is a key part of the assembly that removes the split key once it has been compressed. The extrusion pin 228 is inserted into the "eye" of the split key and is pulled away from the split key by the extrusion assembly 220. There are two types of failure that can occur in the extrusion pin 228. The extrusion pin 228 can fail in bending when the force exerted by the split key on the extrusion pin 228 causes the outside fibers of the extrusion pin 228 to yield. Equation (1) shows the calculation for bending stress.

$$\sigma = \frac{My}{I} = \frac{M \cdot d/2}{\pi \cdot \frac{d^4}{64}} \qquad \text{Eqn. (1)}$$

The equation is then modified by substituting the equation for the second moment of the area of a circle and the distance to the outermost fiber. The shear stress was calculated using equation (2).

$$\tau = \frac{vQ}{It} = \frac{W \cdot h \cdot \left(\frac{2 \cdot d}{3\pi}\right) \cdot \left(\pi \frac{r^2}{2}\right)}{\frac{\pi d^4}{64}} \quad \text{Eqn. (2)}$$

Where, τ is the allowable shear stress, Q is the first moment of the area, I is the second moment of the area, t is the thickness and V is the load on the member.

FIG. 7 illustrates an exemplary pictorial illustration 700 of compression assembly components of the buoy split key removal device, according to an embodiment. The compression assembly 210 comprises: a compression platform assembly 710, a compression frame 720, and a compression power screw 730. The compression platform assembly 710 comprises: a compression power screw platform collar 711, a compression platform back plate 712, a compression platform bottom plate 713, a compression spacer plate 714, a plurality of compression support plates 715, and a compression power screw platform 716. The compression frame 720 comprises: a compression frame back plate 721 and a compression frame bottom plate 722. The compression power screw 730 comprises a thrust bearing 731 on its distal end. The compression power screw platform collar 711 transforms the rotational motion of the compression power screw 730 into a linear motion. This is a prefabricated, cast bronze part. This compression power screw platform collar 711 is bolted to the compression platform back plate 712 via four ¼" bolts. Rubber footers or nonskid can be attached onto the bottom of the BSD to prevent sliding or slipping on a wet deck.

The compression frame 720 is the connection point between the compression platform assembly 710 and the compression power screw 730. The compression frame 720 is constructed of ¼" thick steel plate measuring 4" by 2½". This compression frame back plate 721 has four ¼" diameter holes drilled to match the holes present on the compression bottom plate 722. The compression bottom plate 722 is bolted to the compression frame back plate 721.

The compression frame bottom plate 722 connects the compression spacer plate 714 to the compression platform back plate 712. The compression bottom plate 722 is constructed of ¼" steel measuring 1" by 4". There are two ¼" diameter holes placed equidistance from the center of the piece in order to bolt the compression spacer plate 714 onto this piece. The compression bottom plate 722 is welded to the compression back plate 721.

The compression platform support plates 715 add stiffness and strength to the compression assembly 210 by supporting the compression platform bottom plate 713. The compression platform support plates 715 are welded to both the compression platform back plate 712 and the compression platform bottom plate 713 so that all angles are 90°, the forming the compression platform assembly 710. The compression support plates 715 are made of ¼" steel measuring 2" by 1¼". There are three of these plates 715 included in the compression platform assembly 710.

The compression assembly 210 worked well for split keys spread between zero degrees to ninety degrees. The length of the compression power screw 212, 412 can lengthen to accommodate an increased height between the bottom of the assembly and the compression collar. Teeth can be added to the compression plates to stop the split key from easily sliding out. The spacer plate can tilt from left to right to accommodate for split keys that are vertical and could jam the compression assembly. The slight tilt would press the split key to less than a ninety degree angle, at which point the compression assembly 210 would function as normal.

Each of the thrust bearings was constructed by cutting a piece of round stock to an appropriate length for the desired function and welding on a washer so that it runs perpendicular to the shaft of the round stock. The round stock was prepared by cutting a piece of stock over the required length and then facing the material to ensure that the round stock was set up with a 90 degree face. Plain mild steel washers were selected that both fit around the steel round stock being used and had the required outside diameter. The two parts were welded together using tungsten inert gas welding clamped in the 90 degree angle and left to cool while still clamped to avoid thermal distortion. The thrust bearing created for the compression (vertical) power screw 212 used ¾ inch stock and a ½ inch washer. The thrust bearing created for the extrusion (horizontal) power screw 224 was created using a 12 inch round stock and a ½ inch washer.

The addition of a guard rail along the path of the extrusion power screw 224 keeps the split key and pin straight. The guide rail is attached to the buoy pin rest. This design modification would make the device easier to use and it would require less precision when the device is being set up to use. A lip located on the pin rest holds the split key in line and prevents twisting during extrusion.

Figure 8:
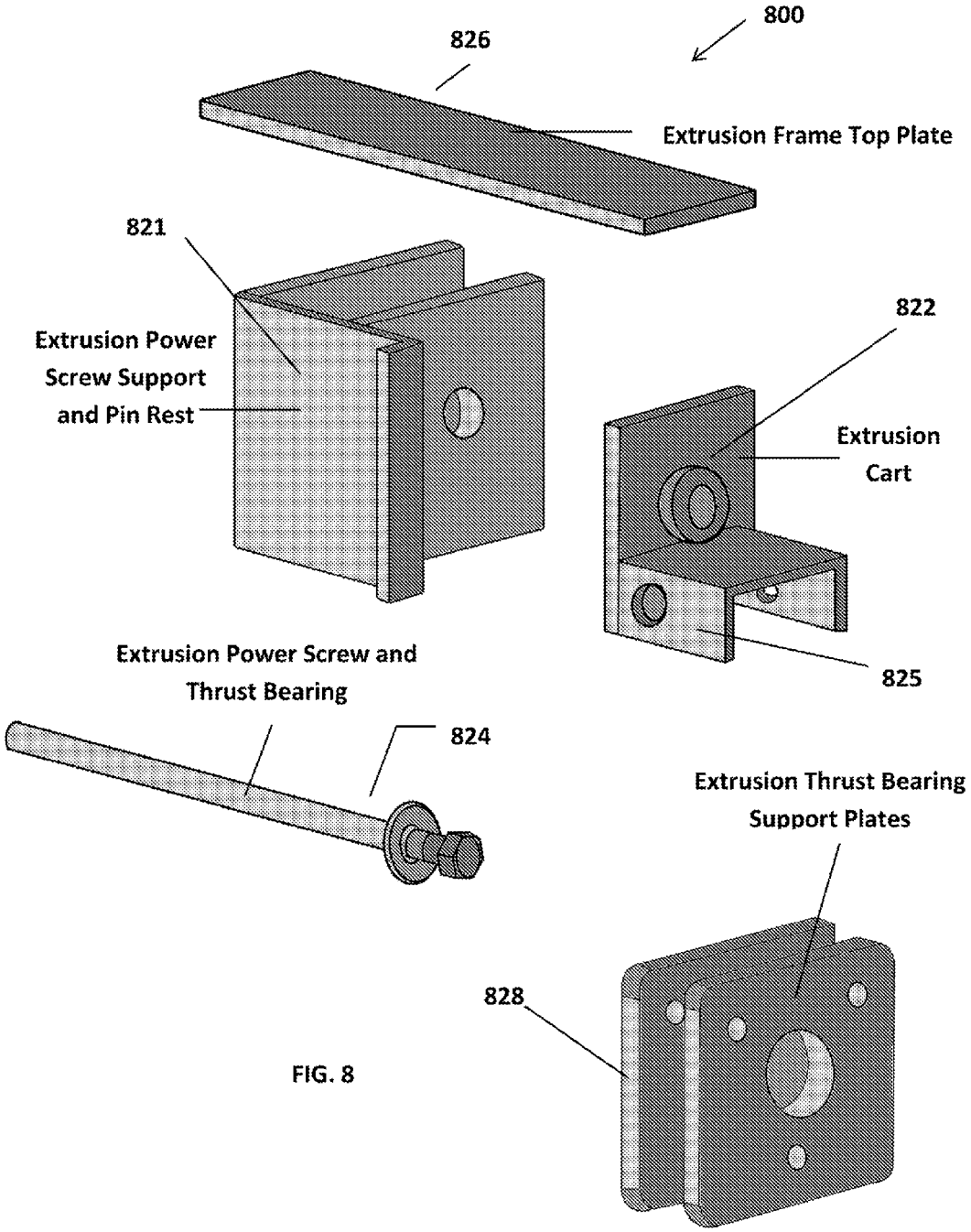
FIG. 8 illustrates an exemplary pictorial illustration of extrusion assembly components of the buoy split key removal device, according to an embodiment.

FIG. 8 illustrates an exemplary pictorial illustration 800 of extrusion assembly components of the buoy split key removal device, according to an embodiment. The extrusion assembly consists of the following components: extrusion top plate 826, power screw support plate and pin support plate 821, extrusion frame back plate pin back stop 825, extrusion thrust bearing power screw 824, extrusion thrust bearing plates 828, and the extrusion cart 822 and pin. The extrusion top plate 826 is the foundation of the extrusion assembly 220 and all of the other parts are welded to this piece. The extrusion top plate 826 is constructed of ¼" thick steel plate measuring 2½" by 9". There are no holes in this piece but all of the other pieces are welded onto this piece.

The power screw support plate 821 supports the end of the extrusion thrust bearing power screw 824 closest to the compression assembly 210. It is constructed of ¼" thick steel plate measuring 2½" by 2". There is one ½" diameter hole in located in the center of this piece. This hole is where the power screw rests. The power screw support plate 821 is welded to the extrusion top plate 826 approximately 1.5" from the end.

The pin support plate 821 supports the end of the extrusion thrust bearing power screw 824 while the device is in operation. It provides reference point for the operator to line up the device correctly so that the compression assembly 210 will fit over the split key. It is constructed of ¼" thick steel plate measuring 2½" by 2½". There are no holes in this piece. The pin support plate 821 is welded to the extrusion top plate 826 along its front edge and forming a 90° angle with the power screw support plate 821.

The extrusion frame back plate provides a flat surface to join the extrusion assembly 220 to the compression assembly 210. It is constructed of ¼" thick steel plate measuring 2½" by 2½". There are no holes in this piece. The extrusion frame back plate is welded onto the extrusion frame top plate, flush with both the end of the plate and the front face of the plate. This piece is parallel to the power screw support plate 521.

The pin backstop prevents the shackle pin from moving with the split key as it is extracted. It is constructed from U-channel steel measuring 1" by 2" by 2½". One end of the channel was ground off to produce an L shape. This piece was welded onto the pin support plate. It is flush with the bottom of the pin support plate 521 but offset to one side by ½".

The extrusion thrust bearing plates 828 prevent the extrusion thrust bearing power screw 824 from coming out of the extrusion frame. They are constructed from ¼" thick steel plate measuring 2½" by 2½". Each piece has three '¼' holes for bolts located at the upper corners of the plate and centrally located ½" from the bottom of the plate. There is also one hole centrally located for the power screw. On one plate this hole measures ½" diameter while on the second plate is measures ¾" diameter. This allows the bolt head on the power screw to pass through the outer thrust bearing plate. The inner thrust bearing plate 828 is welded to the extrusion frame top plate 826 flush with the opposite end of the plate from the extrusion frame back plate. The outer thrust bearing plate is bolted to the inner plate using ¼" diameter bolts and the necessary number of washer to maintain appropriate spacing.

The extrusion collar and pin comprise the extrusion back plate, extrusion collar, and the extrusion U-channel frame and the extrusion bolt. The horizontal power screw collar ensures that the split key removal assembly is in parallel alignment with the horizontal power screw. Bracing it to the assembly frame back ensures that the back of the collar will support the load rather than having the load supported by the collar's threads. The collar is preferably constructed of brass.

The extrusion assembly back plate keeps the assembly from rotating around the power screw and also guides the assembly along the power screw. It is ¼" thick steel. It is 2.5" by 2.25". The collar hole was drilled to 0.9". The plate was welded to the back of the U-channel steel.

The extrusion u-channel provides the body for the extrusion assembly 220. Two ¼" holes are drilled on either side of the U-channel approximately ½" from the edge. The steel u-channel is 1" high, 2" wide, and ¼" thick. A ¼" bolt will be running through the holes in order to extrude the split key.

Figure 9:
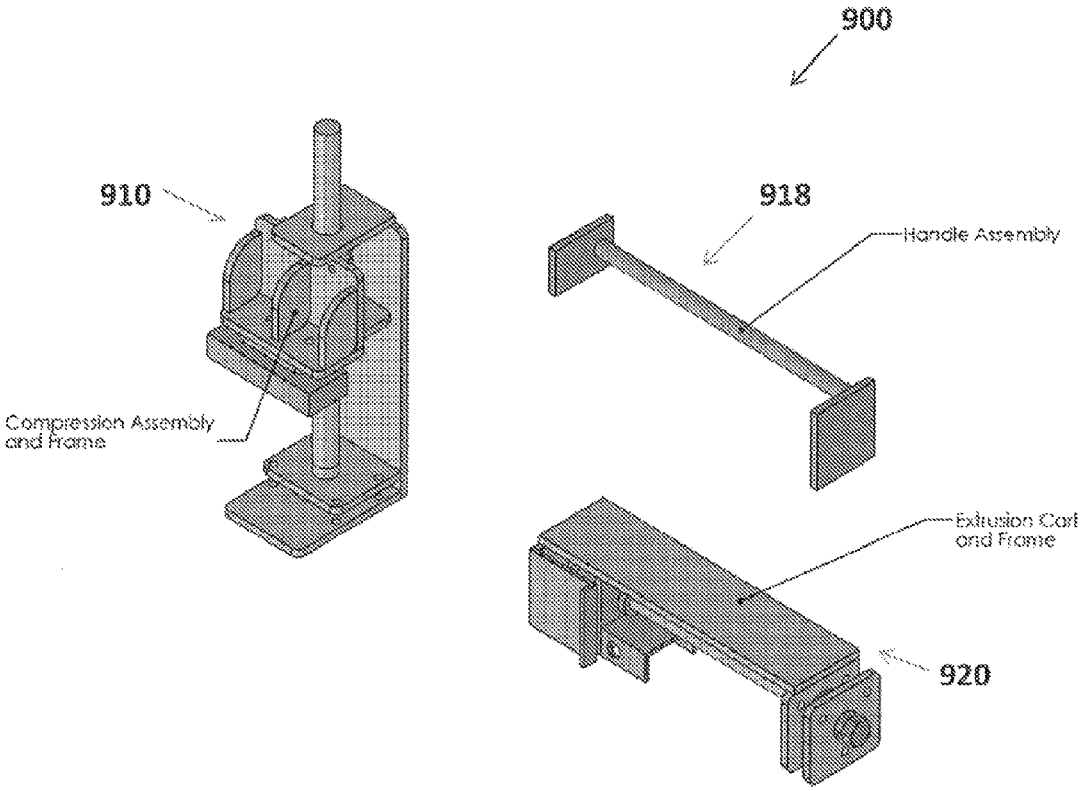
FIG. 9 illustrates an exemplary pictorial illustration of an extrusion assembly, compression assembly, and handle of the split key removal device, according to an embodiment.

FIG. 9 illustrates an exemplary pictorial illustration 900 of an extrusion assembly 910, compression assembly 920, and a handle 918 of the split key removal device, according to an embodiment. The BSD handle 918 comprises two supporting plates and a round stock handle. The supporting plates comprise low carbon steel to provide the main support for the round stock handle. The plates were dimensioned cut with the band saw. The first plate was dimensioned to be 1.5"×2.75"×0.25" and the second plate was dimensioned to be 2"×3"×0.25". These two plates were welded to the handle rod and then welded to the BSD device frame. The round stock handle is made out of low carbon steel. The handle has a dimension of 10" long with an outer diameter of 0.5" and an inner diameter of 0.25". The handle is welded to the two supporting plates.

The bottom of the BSD can be extended all around by ¾". This increase of ¾" will provide the extrusion cart with a higher clearance from the ground. This increase in clearance will enable the extrusion cart to move with ease along the power screw. The horizontal power screw support plate will also be extended out by an additional 2⅛". The primary reason for this addition was to provide the pin with a counter force that will counteract the tendency of the pin to twist when the split key is being extruded.

It will be appreciated that variations of the above-disclosed and other features and functions, or alternatives thereof, may be desirably combined into many other different systems or applications. Furthermore, various presently unforeseen or unanticipated alternatives, modifications, variations or improvements therein may be subsequently made by those skilled in the art which are also intended to be encompassed by the following claims.

What is claimed is:

1. A buoy split key removal apparatus, comprising:

a compression assembly comprising a compression cart and a compression power screw, wherein said compression cart grips a pin back rest of a buoy split key, and said compression power screw compresses said pin back rest of said buoy split key and said compression power screw is thereafter released; and an extrusion assembly comprising an extrusion cart and an extrusion power screw, wherein said compressed buoy split key is lined up with said extrusion cart and wherein said extrusion power screw moves in an opposite manner of said compression power screw, thus releasing said buoy split key.

2. The apparatus of claim 1 further comprising a power screw collar, wherein said power screw collar is placed on top of a shackle pin of said buoy split key to connect said compression assembly to said buoy split key.

3. The apparatus of claim 1 wherein said compression power screw and said extrusion power screw are threaded in opposite directions.

4. The apparatus of claim 1 wherein said compressive power screw applies a steady and controllable compressive load onto said buoy split key.

5. The apparatus of claim 1 further comprising at least one compression arm connected to a power screw collar and gears to maintain steady and controllable compression, wherein a gear end of said at least one compression arms is housed in a casing with a circular collar attached to a gear box.

6. The apparatus of claim 5 wherein said power screw collar is placed on top of a buoy split key shackle pin, wherein a clamp slides over an end of a compressed said buoy split key when said buoy split key is fully compressed.

7. The apparatus of claim 1 wherein said extrusion assembly further comprises a horizontal power screw extrusion collar, wherein said horizontal power screw extrusion collar ensures said extrusion assembly is in parallel alignment with said extrusion power screw.

8. A buoy split key removal system, comprising:

a buoy split key, wherein prongs of said buoy split key are spread or damaged;

a compression assembly comprising a compression cart and a compression power screw, wherein said compression cart grips a pin back rest of a buoy split key, and said power screw compresses said pin back rest of said buoy split key and said compression power screw is thereafter released; and an extrusion assembly comprising an extrusion cart and an extrusion power screw, wherein said compressed buoy spilt key is lined up with said extrusion cart and wherein said extrusion power screw moves in an opposite manner of said compression power screw, thus releasing said buoy split key.

9. The system of claim 8 wherein said buoy split key comprises a 1st-3rd class buoy split key.

10. The system of claim 8 further comprising a power screw collar, wherein said power screw collar is placed on top of a shackle pin to connect said compression assembly to said buoy split key.

11. The system of claim 8 wherein said compression power screw and said extrusion power screw are threaded in opposite directions, and wherein said compression power screw and said extrusion power screw are turned via a drill in a drill fitting on said compression power screw and said extrusion power screw.

12. The system of claim 8 wherein said compressive power screw applies a steady and controllable compressive load onto said buoy split key.

13. The system of claim 8 further comprising at least one compression arm connected to a power screw collar and gears to maintain steady and controllable compression, wherein a gear end of said at least one compression arms is housed in a casing with a circular collar attached to a gear box.

14. The system of claim 13 wherein said power screw collar is placed on top of a buoy split key shackle pin, wherein a clamp slides over an end of a compressed said buoy split key when said buoy split key is fully compressed.

15. The system of claim 8 wherein said extrusion assembly further comprises a horizontal power screw extrusion collar, wherein said horizontal power screw extrusion collar ensures said extrusion assembly is in parallel alignment with said extrusion power screw.

16. A buoy split key removal method, comprising:

compressing a damaged or bent buoy split key via a compression assembly comprising a compression cart and a compression power screw, wherein said compression cart grips a pin back rest of a buoy split key, wherein said compression power screw applies a steady and controllable compressive load onto said buoy split key and said power screw compresses said pin back rest of said buoy split key and said compression power screw is thereafter released; and releasing said damaged or bent buoy split key via an extrusion assembly comprising an extrusion cart and an extrusion power screw, wherein said compressed buoy split key is lined up with said extrusion cart and wherein said extrusion power screw moves in an opposite manner of said compression power screw.

17. The method of claim 16 further comprising utilizing a power screw collar, wherein said power screw collar is placed on top of a shackle pin thus connecting said compression assembly to said buoy split key.

18. The method of claim 16 wherein said compression power screw and said extrusion power screw are threaded in opposite directions.

19. The method of claim 16 further comprising connecting at least one compression arm to a power screw collar and gears to maintain steady and controllable compression, wherein a gear end of said at least one compression arms is housed in a casing with a circular collar attached to a gear box, wherein said power screw collar is placed on top of a buoy split key shackle pin, wherein a clamp slides over an end of a compressed said buoy split key when said buoy split key is fully compressed.

20. The method of claim 16 wherein said extrusion assembly further comprises a horizontal power screw extrusion collar, wherein said horizontal power screw extrusion collar ensures said extrusion assembly is in parallel alignment with said extrusion power screw.

* * * * *